US005564762A

United States Patent [19]

Ring

[11] Patent Number: 5,564,762

[45] Date of Patent: Oct. 15, 1996

[54] ANIMAL WASTE PICK-UP AND DISPOSAL SCOOP APPARATUS

[76] Inventor: Irving Ring, 214 Fourth St., Del Mar, Calif. 92014

[21] Appl. No.: 444,669

[22] Filed: May 19, 1995

[51] Int. Cl.[6] ..... A01K 29/00; E01H 1/12

[52] U.S. Cl. ..... 294/1.3; 294/55; 229/122

[58] Field of Search ..... 294/1.3, 1.4, 1.5, 294/55; 15/257.1, 257.6, 277.7, 104.8; 229/117.13, 122, 229

[56] References Cited

U.S. PATENT DOCUMENTS

| | | | |
|---|---|---|---|
| D. 262,943 | 2/1982 | Schadler | 294/1.3 |
| 3,765,044 | 10/1973 | Hanahan et al. | 15/104.8 |
| 3,885,266 | 5/1975 | Nafziger | 15/257.1 |
| 3,971,503 | 7/1976 | Allan et al. | 229/38 |
| 4,103,952 | 8/1978 | Thompson | 294/55 |
| 4,138,153 | 2/1979 | Brown | 294/1 R |
| 4,154,389 | 5/1979 | Dell'Anno | 294/1.3 |
| 4,205,869 | 6/1980 | Mathis | 294/1.3 |
| 4,222,598 | 9/1980 | Ullger | 294/1 B |
| 4,243,259 | 1/1981 | Wright | 294/1 B |
| 4,715,495 | 12/1987 | Henry | 206/223 |
| 4,747,633 | 5/1988 | Stacy | 294/1.3 |
| 4,809,390 | 3/1989 | Jackson et al. | 15/257.9 |
| 5,020,185 | 6/1991 | Hoefler | 15/257.1 |
| 5,054,828 | 10/1991 | Hantover | 294/1.3 |
| 5,149,159 | 9/1992 | Bardes | 294/1.3 |
| 5,186,384 | 2/1993 | Nelson | 294/1.3 |
| 5,730,431 | 12/1994 | Henninger et al. | 294/1.3 |

FOREIGN PATENT DOCUMENTS

| | | | |
|---|---|---|---|
| 2199476 | 7/1988 | United Kingdom | 294/1.3 |
| 2245818 | 1/1992 | United Kingdom | 294/1.3 |

*Primary Examiner*—Dean Kramer

*Attorney, Agent, or Firm*—Brown, Martin, Haller & McClain

[57] ABSTRACT

An animal waste pick-up and disposal assembly includes a container having an upper, open end and a lower end. A plastic bag having a closed end and an open end, and of length greater than the length of the container, is inserted into the container to act as a liner for the interior surface of the container with a portion of the bag projecting outside of the container. The projecting portion of the bag is folded back over the outside of the container, so that the bag covers both the interior and exterior surface of the container, and also covers the hand of a user gripping the container. Waste is scooped into the bag over the open end of the container while the container and the person's hand are shielded against contamination by the bag which covers them. The open end of the bag is then folded back out and inserted into the container, which is used to carry the bag and contents to a suitable disposal site.

22 Claims, 3 Drawing Sheets

ANIMAL WASTE PICK-UP AND DISPOSAL SCOOP APPARATUS

BACKGROUND OF THE INVENTION

The present invention relates to an apparatus for sanitary and convenient pick-up and disposal of animal waste or excrement.

Disposable animal waste scoops are known for use when walking a dog, for example. Dogs and other pets are often walked on city and park lands, and other public areas. During such walks, the owner is normally required to remove and dispose of any waste or excrement left by their pet. Additionally, pet owners normally remove and dispose of waste left on their own property by their pet. Thus, various types of scoops or devices have been proposed in the past for pet owners to use in picking up and disposing of such waste. Some of these devices comprise permanent scoops or shovels. However, these can be unwieldy and inconvenient to take on walks, and become soiled on use, making them unpleasant to carry. Thus, disposable scoops, bags and the like are known for use in removing waste when a pet is being walked.

Some prior scoops comprise paperboard containers or boxes which have an integral or separate scoop which can be used to scoop waste into the container. Subsequently, the entire container and scoop is discarded. This type of disposal scoop is described, for example, in U.S. Pat. No. 3,971,503 of Allan et al., U.S. Pat. No. 3,885,266 of Nafzigger, and U.S. Pat. No. 4,222,598 of Ullger. One problem with disposable prior art pet waste retrieval systems is the fact that the surface of the container itself becomes soiled during retrieval of the waste, requiring extreme care while transporting the container to a disposal bin. There is also a risk of contaminating the hand of the person holding the container, both as the waste is being picked up and as it is transported to a suitable disposal site. Another problem is that the prior systems must be completely disposed of after only one use, making them relatively expensive as well as wasteful of materials.

SUMMARY OF THE INVENTION

It is an object of the present invention to provide a new and improved animal waste pick-up and disposal scoop assembly.

According to one aspect of the present invention, an animal waste collection and disposal assembly is provided, which comprises a scoop container having an upper, open end, a lower end, an interior surface and an exterior surface, and a plastic bag having a closed end and an open end, the bag having a length greater than the length between the ends of the container, and the bag being insertable into the container to act as a liner for the interior surface of the container with a portion of the bag projecting outside of the container through the open, forward end of the container, whereby the projecting portion of the bag can be folded back over the exterior surface of the container and the hand of a person gripping the container so that waste can be scooped up into the bag and container while the surfaces of the container and the person's hand are shielded against contamination by the bag which covers them. The bag may have a releasable securing mechanism for securing it to the inside of the container.

Preferably, the lower end of the container is openable. The bag preferably has a length approximately twice that of the container, and is releasably secured at its closed end to the lower end of the container, so that approximately half of the bag projects outside the container and can be folded back over the entire outer surface of the container. The plastic bag thus acts as a skin covering both the interior and exterior surface with a waterproof membrane.

The inner surface of the bag will become the outer or exposed surface when the bag is folded back over the outside of the container. Thus, during scooping, waste can only soil the inner, exposed surface of the bag. After scooping, the open end of the bag is pulled back up so the soiled surface is inside the bag.

The open end of the container may be used as a scoop to scoop up waste, and may have a forwardly projecting scoop portion for this purpose. The container is preferably made of paperboard material, but may alternatively be made of other sufficiently rigid materials. Preferably, the container and attached bag are collapsible into a substantially flat condition for easy carrying until needed for use. The container may be of any shape, such as cylindrical or rectangular. In a preferred embodiment of the invention, the container is generally rectangular in shape and has a lower end wall, and spaced front and rear walls and side walls projecting forwardly from the rear end wall. Preferably, each side wall of the container is provided with an outwardly directed fold line, whereby the front and rear walls may be collapsed towards one another so that part of each side wall on opposite sides of the fold line is collapsed into a substantially co-planar condition with the adjacent front or rear wall. With this arrangement, the container may be opened into an erect condition by the user simply pressing the two fold lines inwardly with their hand under the bag. The hand is maintained in this position as the container is used to scoop up waste, forcing the open end into an open, substantially rigid condition. Both the pet owner's hand and the entire surface of the container are protected by the bag which acts as a protective membrane, and the container and pet owner's hand remain clean and germ-free.

Once waste has been scooped up, the user uses his other hand, while still gripping the container, to pull the open end of the bag, which has been covering the gripping hand as well as the outside of the container, forward and off the hand and container, twist it closed, and push the closed end of the bag back into the container. The soiled portion of the bag will be on the interior surface of the bag, where it cannot soil either the surface of the container or the user's hands. The container can then be used to carry the bag to a suitable disposal bin, at which point the bag is removed from the container and discarded.

Preferably, the container also has a handle portion projecting forwardly from its open end, which may be used to carry the container as the used bag is transported to a disposal bin. The handle may be an opening in the scoop portion. A hinged lid portion may be secured to the opening along a transverse fold line to allow the lid to be folded down over the open end of the container, covering and securing the bag as it is being transported for disposal. Since the waste is on the inside of the plastic bag, and the open end of the bag has been closed and pushed into the container, little or no unpleasant odors will be emitted as the assembly is being transported to a suitable location for disposal of the bag and its contents. When the bag is to be discarded, the user can simply urge in the opposite side walls at the fold lines, which causes the folded lid portion to pop open, allowing the bag to be readily discarded. The container will be unsoiled and may be used again as needed, by first inserting a new bag into the interior and folding the open end of the bag down over the outside of the container so that the assembly is ready for use.

In some cases, dependent on the type of ground surface, the waste cannot be readily scooped up using the rim of the container itself or the forwardly projecting scoop portion. A separate, disposable shovel or pusher member is preferably provided for use in such circumstances. This may comprise a simple, flat rectangular piece of paperboard or cardboard. Preferably, the container has a slit in one side wall through which the scoop member is inserted for retention prior to use. The container and bag assembly is used in exactly the same way, but if necessary the pusher member is removed from the slit and held in one hand while the user grips the container beneath the bag with the other hand. The pusher member is then used to push waste over the rim of the bag and container into the bag, and subsequently is discarded into the bag along with the collected waste material. Again, there will be no contamination of the user's hands or the container surfaces, and the bag is simply twisted closed in the same manner as before, and carried in the container to a suitable disposal site where the bag and its contents are discarded. A supply of pusher members will be provided so that a new pusher member can be attached to the container for subsequent use after the original pusher member has been discarded.

The bag may be releasably held in place within the container by means of double-sided adhesive tape secured on one side to the closed end of the bag and having a protective cover over the exposed adhesive surface. When the bag is to be loaded into the container, the protective cover is removed and the adhesive surface is pressed against the closed end inside the container. The two-sided tape is adhered strongly enough to hold the bag firmly in place while it is being used but may be pulled away from the rear end of the container readily when the bag is to be discarded, without tearing the bag.

The container is preferably formed from a single piece of paperboard which has spaced fold lines, tabs and slots for folding into a rectangular, box-like container with a closed end and an open forward end. The construction is inexpensive and the cost to the user is considerably reduced due to the fact that the container itself may be reused. The only parts which are disposed of after only one use are the bags, which are relatively inexpensive, and the separate pusher member, if used. The design of the assembly is such that collection of animal waste is more hygienic and convenient, and collected waste can be transported in a concealed manner to an appropriate disposal bin.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

The drawings illustrate a scoop assembly according to a preferred embodiment of the present invention, as well as the manner in which the scoop assembly is employed in order to collect and dispose of animal waste or excrement, such as waste left by dogs when walking on public lands or roads. The assembly basically comprises a scoop container 10, as illustrated in FIGS. 1–5, and a plastic bag 12 designed for use with the container as illustrated in FIGS. 6–10.

Figure 1:
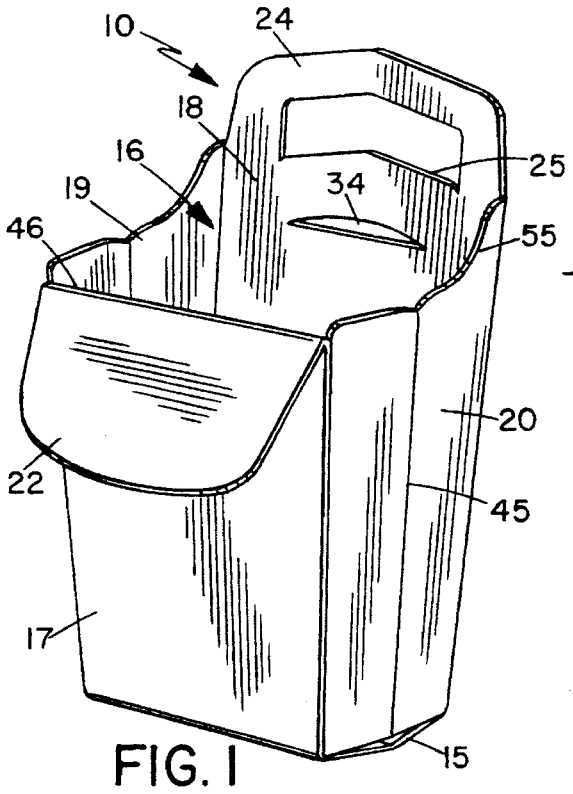
FIG. 1 is a perspective view of the opened container of the scoop assembly according to a preferred embodiment of the invention.

The container 10 will first be described in detail. Container 10 is made of any suitable, semi-rigid or rigid material such as paperboard, cardboard, plastic or the like. Where the container is paperboard, it may have a coating of suitable plastic coating material for water proofing purposes. In the illustrated embodiment, the container 10 is made of paperboard and is formed by cutting a flat blank 14 of the shape illustrated in FIG. 3 and then folding the blank into the assembled, rectangular box-like shape as illustrated in FIG. 1. The container has a closed lower end wall or panel 15, an upper open end 16, spaced front and rear wall panels 17,18 and spaced side panels 19,20. The front panel has an upwardly projecting cover portion 22 at the open end 16, while the rear panel has an upwardly projecting, combined scoop-and-handle portion 24 with a handle opening 25.

Figure 3:
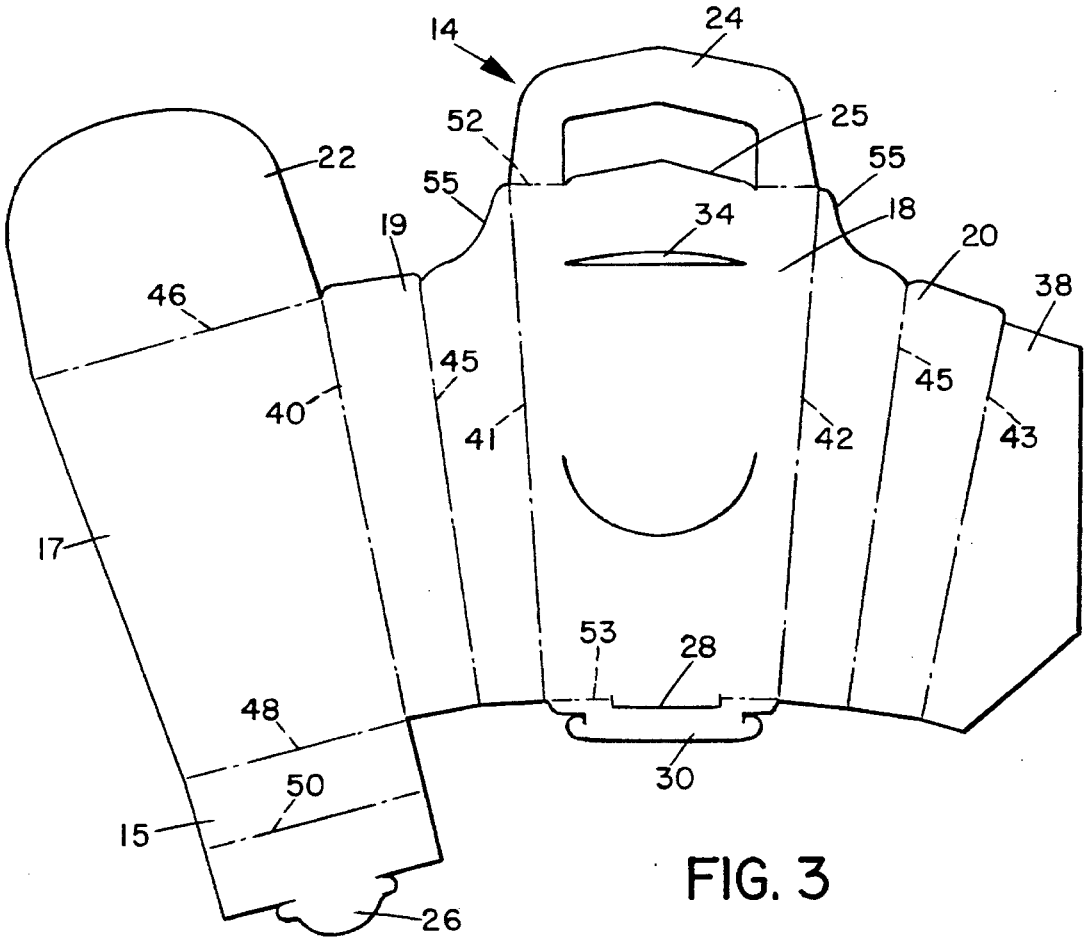
FIG. 3 illustrates the flat blank from which the scoop is formed.

As best illustrated in FIG. 3, the lower panel 15 is formed as a projecting flap from the lower end of the front panel 17, and has a shaped locking tab 26 projecting from its lower edge. The rear panel 18 has a slot or cut 28 dimensioned to receive the locking tab 26, and a downwardly projecting tab 30. Arcuate slit 32 is formed in the central portion of the rear panel 18. Transverse slot 34 is formed in panel 18 in alignment with the lower edge of scoop portion 22. A side flap 38 projects to one side of one of the side panels 20. Fold lines are formed between the respective panels and projections in the blank 14. A first set of parallel fold lines 40,41,42, and 43 are formed between front panel 17 and side panel 19, side panel 19 and rear panel 18, rear panel 18 and side panel 20, and side panel 20 and side flap 38, respectively. Each side panel is also provided with a central, longitudinal fold line 45 which is directed outwardly when the container is assembled. A transverse fold line 46 is provided between the front panel and scoop portion 22, and a further transverse fold line 48 is provided between the lower end of front panel 17 and the lower wall panel 15. A central, fold line 50 is also provided across the lower panel 15. A transverse fold line 52 is provided across scoop portion 24 at the lower end of the handle opening, while a lower fold line 53 is provided between the panel 18 and the tab 30. Reinforcing side webs 55 are formed in each side panel and extend up to fold line 52 of the scoop portion 24.

Figure 5:
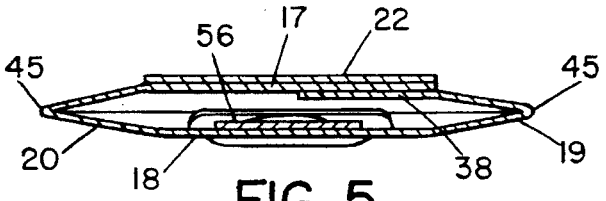
FIG. 5 is a sectional view taken on line 5—5 of FIG. 2.

In order to assemble the container, the panels 17,19,18 and 20, and side flap 38 are folded inwardly about their respective fold lines to form a rectangular container with the side flap 38 on the inside of the container. Flap 38 is suitably adhered to the inner surface of front panel 17, as best illustrated in FIG. 5. The lower panel 15 is folded about fold line 48 while tab 30 is folded upwardly about fold line 53, and locking tab 26 is then inserted through slit 28 with the tab 30 on the inside. Tab 30 may be adhered to the inner surface of panel 15 if desired.

Figure 2:
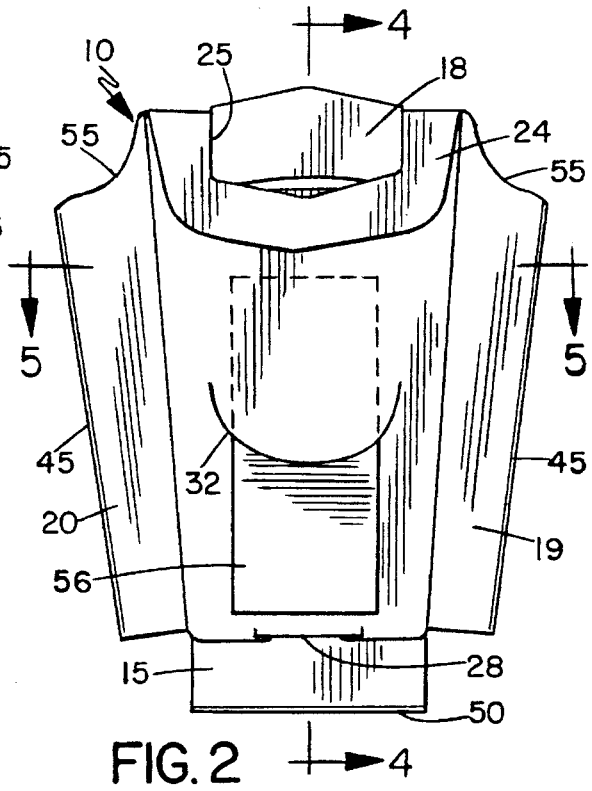
FIG. 2 is a rear view of the scoop folded flat.
Figure 4:
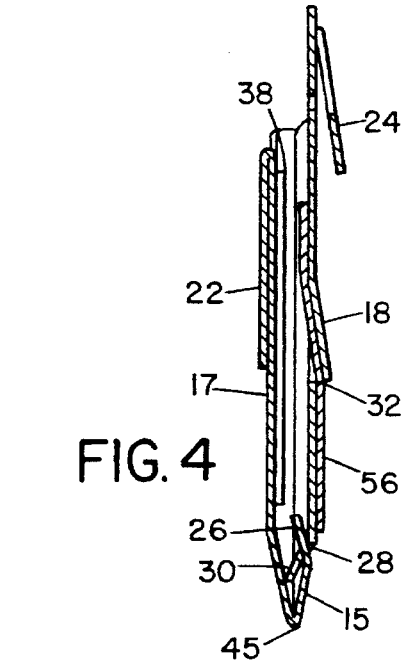
FIG. 4 is a sectional view taken on line 4—4 of FIG. 2.

The erected container 10 of FIG. 1 may be folded into a substantially flat condition for storage, as illustrated in FIG. 2. As best illustrated in FIG. 1, when the container is open and erect, the side panel fold lines 45 and lower panel fold line 50 are directed slightly outwardly. If the front and rear panels 17 and 18 are urged towards one another, the fold lines 45 and 50 will be pressed outward further and the side and lower panels will be flattened on opposite sides of the respective fold lines 45 and 50, as illustrated in FIGS. 2, 4 and 5. The handle portion 24 has a slight V-shape with a point at its upper edge, as illustrated in FIG. 1 and 3, and the upper portion may be folded down when the container is collapsed flat, as best illustrated in FIG. 2. Cover portion 22 may also be folded down against the outside of front wall 17, as illustrated in FIG. 4.

A separate scoop or pusher member 56, which preferably comprises a flat, rectangular piece of paperboard or cardboard, is preferably releasably inserted through the arcuate slot 32 in the rear panel, as illustrated in FIGS. 2 and 4. The arcuate shape of the slot will help to hold the pusher member 56 flat against the rear panel until it is needed.

Figure 10:
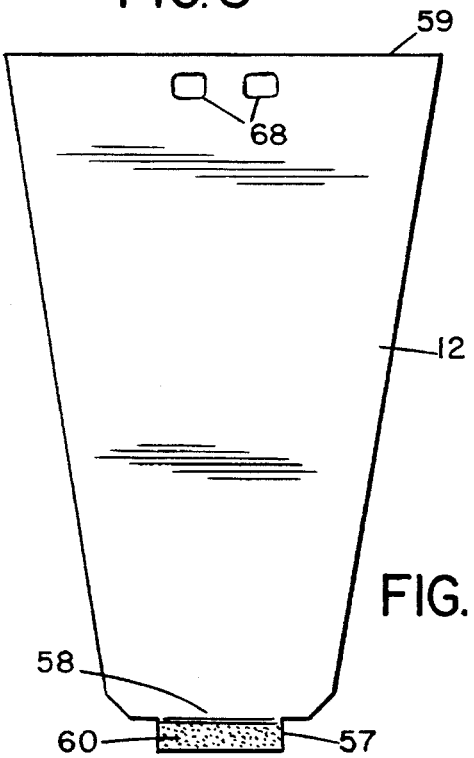
FIG. 10 is a front elevation view of the bag prior to use.

Bag 12 is of plastic material of the type commonly used for disposable garbage bags and the like, and has a closed end 58 and an open end 59. The plastic material is relatively inexpensive but is strong and impervious to penetration of water and waste. Preferably, plastic of approximately 0.09 mil. thickness is used for the bag. Bag 12 is of a length greater than the length of erect container 10 from the closed end panel 15 to the open end 16. Preferably, the length of the bag is approximately double that of the container. As best illustrated in FIG. 10, the bag is preferably of a generally conical or tapered shape, having a narrower closed end 58 and a wider open end 59. A projecting tab 57 is provided at the lower end of the bag. An adhesive strip 60 or a strip of double-sided adhesive tape is adhered on one side to the tab 57 at the closed end 58 of bag 12. The exposed adhesive surface has a peel-off protective cover (not illustrated) which protects it until the bag is to be used. Finger openings 68 are provided adjacent the open end of the bag.

Figure 6:
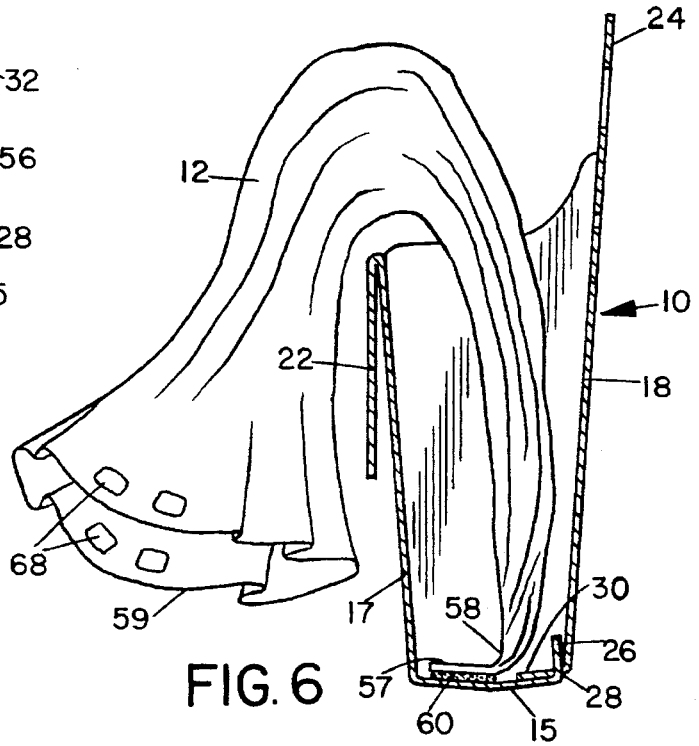
FIG. 6 is a sectional view showing the insertion and attachment of the plastic bag.

When a pet owner wishes to use the scoop assembly, a bag is taken from a suitable supply or dispenser of bags 12, and the peel-off protective cover is removed from strip 60. The container 10 is then expanded into its open, erect condition by pressing the fold lines 45 at the sides inwardly, pushing the front and rear walls apart and erecting the container into a rectangular configuration. With the bottom flap or lower wall panel open, the closed end of the bag 12 is then inserted into the container and pulled through the lower open end of the container. The tab 57 is then adhered to the inside of the lower wall or flap 15, using adhesive strip 60. The lower flap or wall is then re-closed by inserting tab 26 through slot 28, as illustrated in FIG. 6, with the upper, open end portion of the bag projecting out of the open end of the container. The bag dimensions are such that the dimensions of the open end of the container are substantially the same as the cross-sectional dimensions of the bag at the location aligned with the open end of the container at this point. This helps to hold the bag up.

Figure 7:
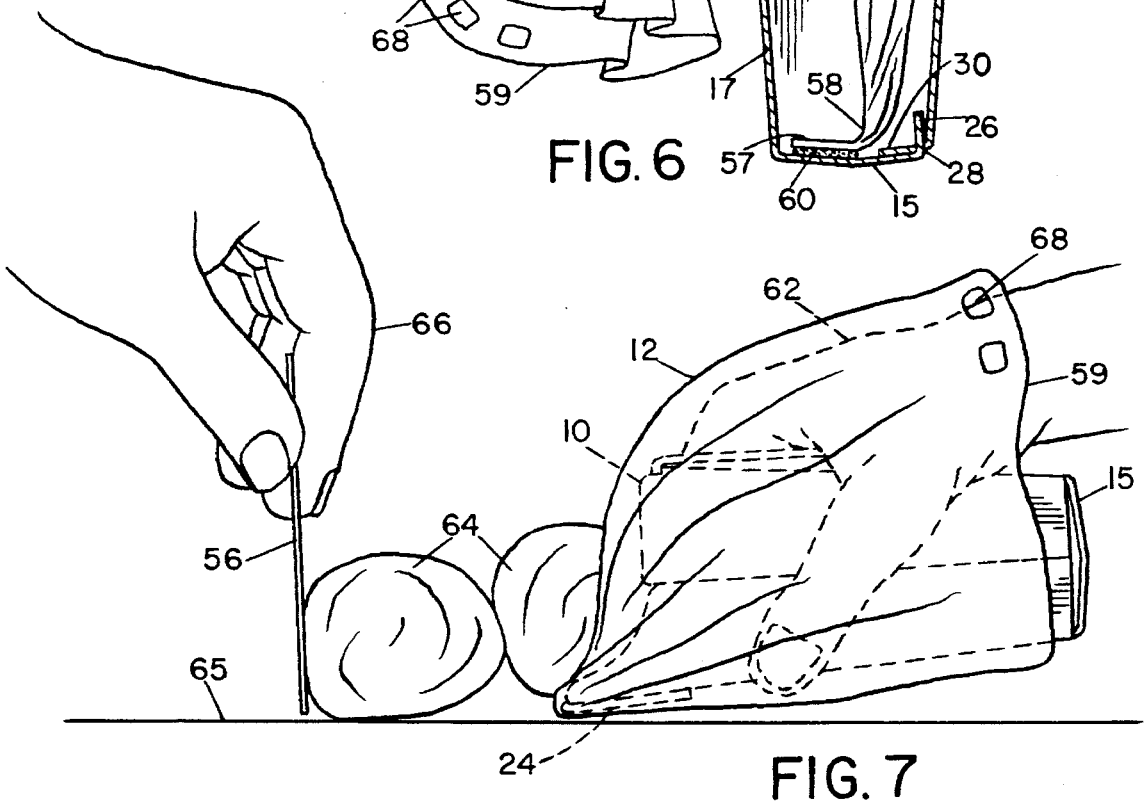
FIG. 7 illustrates the scooping action.

The bag is then opened out and the open end is folded back over the outside of the container to cover both the outer surface of the container as well as the hand 62 of a user gripping the container, as illustrated in FIG. 7. The larger diameter open end of the bag makes it easier to fold the bag back down over the container. The cover portion 22 will be bent back out of the way in this condition, as will the handle part of scoop portion 24. Scoop portion 24 is relatively rigid due to side webs 55. When the outer portion of the bag has been folded back into the condition illustrated in FIG. 7, the plastic bag becomes a skin or protective coating covering both the inside and outside surface of the container.

In order to use the assembled container and bag to retrieve pet waste or fecal matter 64 from the ground 65, the user may first remove the separate scoop or pusher member 56 by sliding it out of slot 32. Scoop or pusher member 56 is gripped by the user in the other hand 66. The first hand 62 which grips the container beneath the folded-back portion of the bag 12 is used to press in against fold lines 45. This acts to hold the container open and also increases rigidity of the front panel 17 and projecting scoop portion 24, which acts as a base onto which the waste material is scooped. By means of inward pressure on the side walls, the rear panel and scoop portion is curved or bowed outwardly, increasing rigidity. In some cases, the rigidity may be sufficient to enable the waste material 64 to be scooped up, using the scoop portion 24 in a shovel-like manner to scoop the material over the scoop portion 24 and into the bag. However, in some cases, separate scoop or pusher member 56 may be needed to push the waste material 64 over the scoop portion 24 and into the bag within the container, as illustrated in FIG. 7. After all waste material has been collected into the bag within the container, the soiled pusher member 56, if used, is also discarded into the bag.

Since the bag covers both the inside and outside surface of the container, as well as the user's hand, neither the container nor the user's hand can become soiled during scooping. Additionally, since it is actually the inside surface of the bag, not the outside, which is exposed during scooping, the outside surface of the bag also remains clean.

Figure 8:
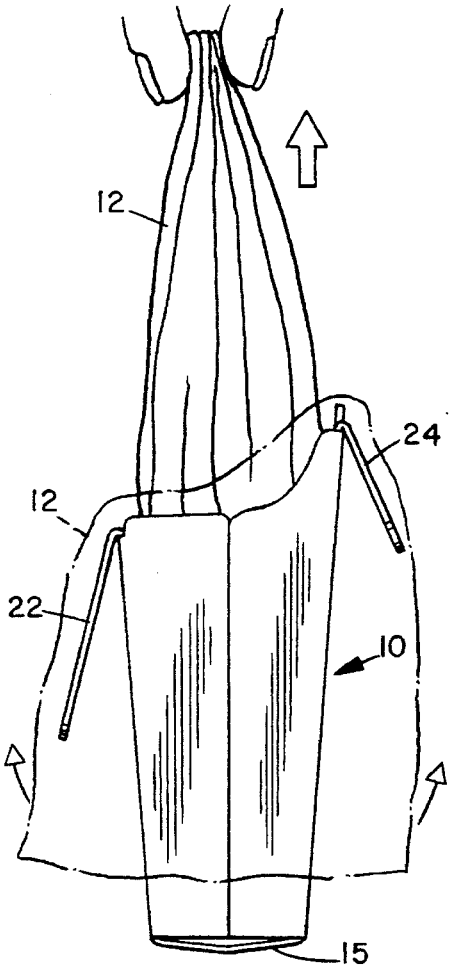
FIG. 8 is a side view showing the bag closed after use.
Figure 9:
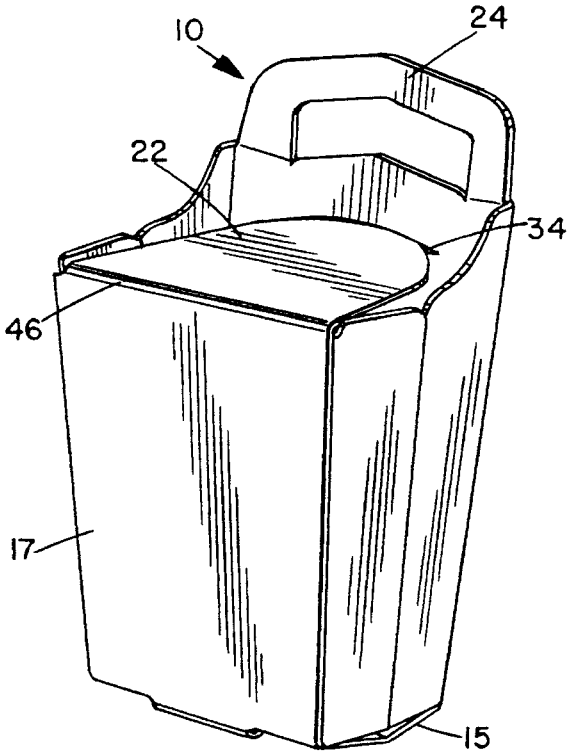
FIG. 9 illustrates the scoop with the cover closed to contain the bag.

After the waste has been picked up in this manner, while the person is still holding the scoop container 10 in one hand 62, the bag will be in the dotted line position illustrated in FIG. 8. The user then uses the other hand 66 to grasp the bag at the open end 59 and pull the bag outwardly and upwardly, in the direction of the arrows in FIG. 8 and into the solid line position illustrated in FIG. 8. Finger pull handles 68 are preferably provided at the open forward end 59 of the bag for gripping by the user when folding the bag over the outside of the container as in FIG. 7, or back upwardly when waste has been collected, as in FIG. 8, although these are not essential. The hinged portion of the handle, as well as the hinged cover flap will not lie completely flat but will project outwardly as in FIG. 8. This tends to take up some of the slack when the bag is pulled off, holding the soiled part of the bag in place so that it doesn't move and potentially soil hand 66. The hinged cover flap and hinged part of the handle flap will tend to project outwardly, acting as a guide for the bag as it is pulled forward. The flaps also act to restrain the bag from bunching up as it is being pulled forward off the hand and container. When the bag is completely pulled up from the outside of the container, as in FIG. 8, all of the animal waste as well as the soiled surface of the bag will be on the inside of the waterproof bag. The bag is given a slight tug in an upward direction as indicated by the arrow in FIG. 8. This releases tab 57 from the end flap or panel 15. The end of the bag is then twisted one or two turns and pushed back into the container. If desired, the open end may be secured by a paper-covered twist wire or the like. The cover portion 22 is bent downwardly about fold line 46 over the open end of the container, and the forward edge is snapped into slot 34, which is provided for this purpose. Cover portion 22 then acts as a lid, covering the contents of the container, as illustrated in FIG. 9. The handle portion is pulled up, and the closed container can be carried by the user gripping the upwardly projecting handle portion 24 through opening 25. Thus, the bag containing the waste material is kept within the container and is completely concealed while the user is carrying the container to a suitable disposal bin. Since only internal surfaces of the bag are exposed as the waste is collected, the external surface of the bag remains clean, as do all surfaces of the container itself. Since the waste is retained inside the bag and the bag itself is closed and pushed into the scoop container, little or no unpleasant odors will be emitted during the disposal process.

When an appropriate disposal facility such as a trash bin or the like is reached, the user simply presses in the sides 19,20 of the scoop container at the fold lines 45. This causes the open end of the scoop container to be enlarged, and releases the cover portion 22 from slot 34, whereupon it snaps up into the open condition. The finger pull openings 68 may be grasped and the bag pulled slightly to release adhesive strip 60 from the container. The container can then be inverted so that the bag and its contents slide out into a suitable disposal bin. This system allows the pet owner to carry pet waste back to a suitable place of disposal without the unpleasantness of any odor or soil on the outside of the container that he or she is carrying.

Once the bag and its contents have been disposed of, the container may be reused in an identical fashion with a new bag 12 and a new scoop or pusher member 56. A bag 12 may be initially inserted into the container and secured to the end wall, with the open end folded back to cover the outside of the container, and the container may be collapsed flat as in FIGS. 2, 4 and 5 with the bag already positioned to line the inside and cover the outside of the container. In this condition, the scoop container together with the bag may be readily carried in a pocket, handbag or the like.

The function of the scoop container 10 is to act as a rigid form to hold the plastic bag and to allow the person picking up the waste to hold the container while keeping his or her hand separated from contact with the waste itself. Where the container is of paperboard, it is usable repeatedly for a period of up to one month, but will eventually deteriorate and must be replaced. Paperboard having a thickness of approximately 0.024" will be sufficiently rigid for proper operation of the scoop container or form. With the disposable bag of this assembly, the container may be made of other, more durable materials if desired, although paperboard is the least expensive and has the advantage of being readily collapsible into a flat condition for easy carrying by a pet owner while walking a pet.

With this combination of a plastic bag and more rigid scoop container, the plastic bag becomes a skin to the container, covering both the interior and exterior with a waterproof membrane. The bag takes on the rigidity and shape of the container, performing the function of the container. Neither a plastic bag alone nor a container alone could do this. A bag alone will be too floppy. A container alone, without this protective skin or bag, would become soiled on both the inside and the outside of the container. Upon removing the protective bag after use, the container remains clean and germ-free. The pet owner's hand is also shielded from contact or contamination with the pet waste at the same time during use. The inexpensive plastic bag takes on the same scooping and containing qualities of a rigid and waterproof container at a small fraction of the cost.

Figure 11:
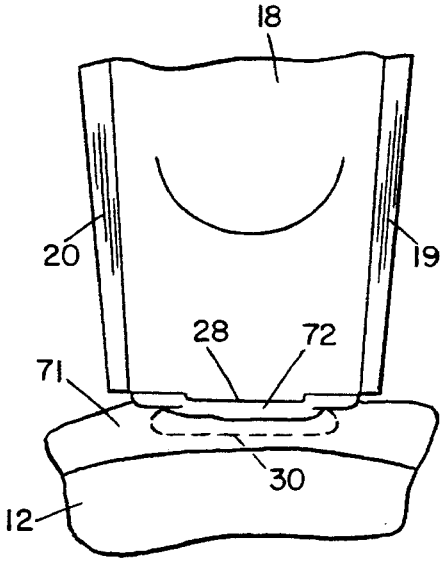
FIG. 11 illustrates a modification for attachment of the plastic bag to the scoop container.

Although in the illustrated embodiment the bag is secured in the container by means of a strip of double-sided adhesive tape, the bag need not necessarily be positively secured to the container but may be simply deployed into the position illustrated in FIG. 7 by the user holding part of the bag while folding back the open end portion with the other hand. In another alternative embodiment, as illustrated in FIG. 11, the closed end of the bag may be provided with a downwardly projecting tab 71 having a slit 72 for fitting over tab 30, which will hold the bag down inside the container. When the bag is to be discarded, the user simply opens the bottom flap 15 in order to release the end of the bag.

Although the container is of generally rectangular shape in the illustrated embodiment, it may alternatively be round or cylindrical in other embodiments. However, a rectangular shape provides a flat edge which is better for scooping purposes.

This arrangement provides an easy, inexpensive and convenient system for retrieving and disposing of pet waste. Pet or dog owners can retrieve pet waste with no risk of soiling their hands, and are provided with a convenient closed container with a carrying handle for convenient transportation of the bag containing the waste. The technique avoids contamination of any exterior surface of the bag itself with waste, since only internal surfaces of the bag will be exposed as the waste is being collected. It also avoids contamination of any surfaces of the container. Thus, once the bag is twisted closed and pushed down into the container, the waste material will be completely contained inside the bag, while the outside of the bag and the surface of the container will be completely clean. This avoids the unpleasantness of carrying a visibly soiled scoop, and avoids the risk of the pet owner's hands or clothing becoming soiled during collection or transportation.

Although a preferred embodiment of the invention has been described above by way of example only, it will be understood by those skilled in the field that modifications may be made to the disclosed embodiment without departing from the scope of the invention, which is defined by the appended claims.

I claim:

1. Animal waste pick-up and disposal assembly, comprising:

a container having an upper, open end, a lower end, an interior surface and an exterior surface;

a plastic bag having a closed end and an open end, and having a length equal to at least twice the length of the container;

the closed end of the bag being inserted into the interior of the container to act as a liner for the interior surface of the container with a portion of the bag projecting outside the container through the open, upper end of the container;

the closed end of the bag being releasably secured to the lower end of the container; and the projecting portion of the bag comprising means for folding back rearwardly over the exterior surface of the container and the hand of a user gripping the container underneath the projecting portions of the bag, whereby the open end of the container covered by the bag may be used to scoop up waste into the interior of the bag within the container, with the projecting portion protecting the outside of the container and the hand of the user.

2. The assembly as claimed in claim 1, wherein the bag in a flattened condition has opposite side edges which taper inwardly from the upper end to the lower end to form a conical, tapered shape, the closed end of the bag having a width between the side edges less than the width across the open end between the side edges.

3. The assembly as claimed in claim 1, wherein the bag has finger grip openings adjacent the open end.

4. The assembly as claimed in claim 1, wherein the lower end of the container comprises a hinged flap movable between an open position in which the lower end of the container is open and a closed position closing the open lower end of the container.

5. The assembly as claimed in claim 1, wherein the upper, open end of the container is a scoop portion for assisting in picking up waste from the ground.

6. The assembly as claimed in claim 5 wherein the container is rectangular and has a lower end wall and spaced front, rear and side walls projecting forwardly from the lower end wall, the scoop portion projecting from the rear wall of the container.

7. The assembly as claimed in claim 6, wherein each side wall has a forwardly projecting web portion extending from a predetermined position at the forward end of the side wall up to the scoop portion for reinforcing the scoop portion.

8. The assembly as claimed in claim 1, including a handle portion projecting forwardly from the open end of the container for gripping by a user to carry the container to a disposal site when waste is held within the bag in the container.

9. The assembly as claimed in claim 1, including a cover portion hinged to the open end of the container, the cover portion being of shape and dimensions for covering the open end of the container in a cover position, and being movable between an inoperative position folded down over the outside of the container and a cover position folded over the open end of the container.

10. The assembly as claimed in claim 9, wherein the container is rectangular and has spaced front and rear walls and spaced side walls, and the cover portion is formed integrally with the front wall and is secured to the forward end of the front wall along a fold line, the opposing rear wall of the container having a linear slit aligned with the fold line, and the cover portion having a forward edge for releasable engagement in the slit in the cover position to hold the cover portion closed.

11. The assembly as claimed in claim 1, wherein the container is made of paperboard.

12. The assembly as claimed in claim 1, wherein the closed end of the bag includes adhesive means for releasably securing the bag to the interior of the container.

13. The assembly as claimed in claim 1, wherein the container is of rectangular cross-section and has a front wall, a rear wall, and opposite side walls extending between the front and rear walls, each side wall having a longitudinally extending, outwardly directed fold line whereby the container may be folded between a flat, collapsed position in which the respective parts of each side wall on opposite sides of the fold line are substantially co-planar with the adjacent front and rear wall, respectively, and an open position in which the fold in each side wall is urged inwardly and each side wall is substantially perpendicular to the front and rear walls.

14. The assembly as claimed in claim 1, wherein the container has a slit, and a separate, flat pusher member extends transversely through the slit with a first portion of the pusher member lying on the outside of the container flat against said exterior surface and a second portion of the pusher member on the inside of the container lying flat against said interior surface, said pusher member being releasably held in the slit, the separate pusher member comprising means for pushing waste over the open end of the container and into the bag within the container.

15. The assembly as claimed in claim 14, wherein the slit is arcuate.

16. The assembly as claimed in claim 1, wherein the container is rectangular and has spaced front and rear walls and spaced side walls, each of the front and rear walls having an integral, forwardly projecting portion extending forwardly from the open end of the container and connected to the remainder of the front and rear wall, respectively, by a fold line, a first one of the projecting portions comprising a cover portion and being foldable about the fold line between a first, rearwardly bent position projecting rearwardly on the outside of the container and a second, cover position folded over the open end of the container, and a second of the projecting portions comprising a combined handle and scoop portion and being foldable about the fold line between a first, rearwardly bent position projecting over the outside of the container and a second, operative position extending co-planar with the container wall forwardly from said open end to act as a handle, the second projecting portion having a handle opening for gripping by a user's hand in the operative position to carry the container, and including a projecting scoop member projecting forwardly from said open end when said projecting portion is in said first, rearwardly bent position.

17. The assembly as claimed in claim 1, wherein the length of the bag is approximately twice the length of the container.

18. Animal waste pick-up and disposal assembly, comprising:

a container having upper, open end, a lower end, an interior surface and an exterior surface;

a plastic bag having a closed end and an open end, and having a length greater than the length of the container;

the closed end of the bag being insertable into the interior of the container to act as a liner for the interior surface of the container with a portion of the bag projecting outside the container through the open, upper end of the container;

the projecting portion of the bag comprising means for folding back rearwardly over the exterior surface of the container and the hand of a user gripping the container underneath the projecting portions of the bag;

the container being rectangular and having spaced front and rear walls and spaced side walls, the front and rear walls being wider than the side walls;

a handle portion comprising an integral extension of the rear wall projecting forwardly from the rear wall of the container and having an opening for gripping by a user's hand to carry the container;

the opening having an upper edge and a lower edge, and a fold line extends across the handle portion at the lower edge of the opening, whereby part of the handle portion can be folded down over the outside of the container into an inoperative position when not in use;

the handle portion comprising a combined handle and scoop for assisting in scooping up waste; and the lower edge of the opening including a forwardly projecting scoop portion;

whereby the scoop portion covered by the bag may be used to scoop up waste into the interior of the bag within the container when the handle portion is folded down into the inoperative position, with the projecting portion protecting the outside of the container and the hand of the user.

19. A method of collecting and disposing of animal waste, comprising the steps of:

placing the closed end of a plastic bag into a container and releasably securing the closed end to a closed end of the container so that the bag acts as a liner for the inside of the container and has a portion extending outwardly from the open end of the container, the bag having an inner surface and an outer surface;

gripping the outer surface of the container with one hand and folding the extending portion of the bag back over the outer surface of the container and the gripping hand so the inner surface of the bag faces outwardly and the bag acts as a liner covering the entire inner and outer surface of the container as well as the gripping hand;

scooping waste over the open end of the container and folded bag and into the bag;

pulling the folded-back portion of the bag back towards and over the open end of the container, and pushing the entire bag back into the inside of the container to contain the waste;

carrying the container and waste containing bag to a waste disposal receptacle;

detaching and removing the bag from the container and discarding the waste containing bag only into the receptacle; and inserting a new bag into the container for subsequent waste collection.

20. The method as claimed in claim 19, including the step of closing the open end of the bag after pulling the folded-back portion back over the open end of the container.

21. The method as claimed in claim 19, including the step of bending a forwardly projecting portion of one wall of the container at the open end of the container outwardly and rearwardly so that it extends rearwardly over part of the outer surface of the container and projects outwardly away from the container, prior to folding the extending portion of the bag back over the rearwardly bent projecting portion and the outer surface of the container, whereby the rearwardly bent projecting portion biasses overlying portions of the bag outwardly to hold the bag open and provide a space for the user's hand to grip the container beneath the folded-back portion of the bag, and retains a soiled portion of the bag after use on the open end of the container as the open end of the bag is pulled back over the open end of the container.

22. The method as claimed in claim 21, including the step of bending a second forwardly projecting portion of a wall of the container opposite to said one wall rearwardly over an opposing part of the outer surface of the container, whereby both forwardly projecting portions are bent rearwardly prior to folding the extending portion of the bag rearwardly over the rearwardly bent projecting portions, each rearwardly bent projecting portion biassing overlying bag portions outwardly to hold the bag open during use and retain soiled portions of the bag on the open end of the container as the bag is pulled back after use.

* * * * *